United States Patent [19]

Grimm et al.

[11] Patent Number: 4,594,105

[45] Date of Patent: Jun. 10, 1986

[54] CASTING POWDER FOR THE CONTINUOUS CASTING OF STEEL AND A PROCESS FOR THE CONTINUOUS CASTING OF STEEL

[75] Inventors: Robert Grimm, Bergheim; Bernd Sowade, Bergisch-Gladbach, both of Fed. Rep. of Germany

[73] Assignee: Bayer Aktiengesellschaft, Leverkusen-Bayerwerk, Fed. Rep. of Germany

[21] Appl. No.: 693,621

[22] Filed: Jan. 22, 1985

[51] Int. Cl.[4] ..... C22B 21/00

[52] U.S. Cl. ..... 75/257; 75/53; 75/58

[58] Field of Search ..... 75/257, 53–58

[56] References Cited

U.S. PATENT DOCUMENTS

| | | | |
|---|---|---|---|
| 2,281,528 | 4/1942 | Berger | 75/257 |
| 3,788,840 | 1/1974 | Koenig | 75/257 |
| 3,816,099 | 6/1974 | Fergusson | 75/257 |
| 3,877,933 | 4/1975 | Pargeter | 75/257 |
| 3,984,236 | 10/1976 | Koenig | 75/257 |
| 4,447,265 | 5/1984 | Schwer | 75/257 |

*Primary Examiner*—Peter D. Rosenberg

*Attorney, Agent, or Firm*—Connolly and Hutz

[57] ABSTRACT

A casting powder useful in continuous casting of steel contains inorganic oxidic material meltable at the steel casting temperature and active carbon having a specific surface area according to BET of from 800 to 1200 square meters per gram.

6 Claims, 2 Drawing Figures

CASTING POWDER FOR THE CONTINUOUS CASTING OF STEEL AND A PROCESS FOR THE CONTINUOUS CASTING OF STEEL

FIELD OF THE INVENTION

This invention relates to a new casting powder for the continuous casting of steel and to a process using this casting powder.

BACKGROUND OF THE INVENTION

The function of the casting powder in the continuous casting of steel is very complex. The casting powders first act as mould-release agents or as lubricants between the mould and the billet of steel. They also serve to cover the surface of the steel bath on the mould to prevent the surface oxidation of the steel bath due to the entry of atmospheric oxygen and further to reduce the heat loss from the surface of the steel bath. Thus, the flow bahavior of the casting powder is determinant with regard to the properties of the lubricant required, as is the melting behavior of the powder when it has been applied to the surface of the steel bath. The powder must be prevented from melting too rapidly because the unmelted, loose porous structure provides particularly good heat insulation properties.

Thus, on the surface of the steel melt, the casting powder passes through all the physical states from a loose, pourable powder to a flowable melt. Undesirable sintering effects, which occur in the transition region, produce large continuously porous sintered agglomerates which are very slow to make the transition into the flowing range because of the good heat insulation properties thereof. Sintered agglomerates of this type can also enter between metal shell and mould in an unmelted state and cause the steel billet to have surface defects, inclusions and a rough surface. In extreme cases such unmelted agglomerates can even bread open the outer shell of the billet and thus stop production. Thus, those skilled in the art are aware of the detriment caused by large agglomerates of casting powder and have sought to achieve compositions which have a low agglomeration tendency.

One known method of reducing the formation of agglomerates involves using multiphase systems as casting powders which contain a mixture, an inorganic oxidic material and particles substantially of carbon, which prevent the inorganic oxidic materials from melting together too rapidly.

The inorganic oxidic material is generally based on calcium silicate and oxidic raw material which may melt together on the surface of the steel bath or be used in the form of substantially homogeneous particles which have been pre-melted, fritted and milled. Aluminium oxide, titanium dioxide, iron oxide, manganese oxide, alkali and alkaline earth metal oxides and fluorine compounds, in addition to calcium oxide and silicon dioxide may be used as components of the inorganic oxidic material.

According to the prior art, graphite powder, mineral coal powder or lignite or carbon black are admixed with the inorganic oxidic material as the material substantially of carbon. The purpose of the carbon-containing material is to delay the sintering and melting together of the inorganic oxidic powders on the surface of the steel bath so that the desired porous layer which prevents the heat loss can be maintained. Atmospheric oxygen is simultaneously prevented from being admitted to the surface of the steel bath by combustion with the carbon-containing material to produce carbon oxide.

The quantitative ratio of inorganic oxidic and carbon-containing material is substantially determined by the cross section of the mould. Up to 25% by weight of carbon is contained in the casting powder in very small billet or bloom cross-sections. From 3 to 8% by weight of carbon in the casting powders suffices in very large slab cross-sections. The relatively high contents of carbon which were hitherto used in the casting powder frequently caused undesirable peripheral carburizing of the billet steel shell and flake cracks in the region of oscillation marks. Proposals have already been made to substitute the carbon particles in the casting powder with nitride particles (such as boron nitride) with the simultaneous addition of metallic particles (such as aluminium) as a reducing agent for the atmospheric oxygen ( U.S. Pat. No. 4,038,067).

However, casting powders of this type have not yet found their way onto the market.

BRIEF DESCRIPTION OF THE INVENTION

The present invention provides a casting powder for the continuous casting of steel which comprises an inorganic oxidic material meltable at the casting temperature and a substantially carbon-containing material, characterized in that the carbon-containing material is active carbon having a specific surface, according to BET, of from 800 to 1200 $m^2/g$.

DETAILED DESCRIPTION

It has been found that even a very small content of fine-grained active carbon having a high specific surface in the casting powder guarantees adequate heat insulation and provides a large avid surface for the atmospheric oxygen present to oxidize. The casting powders according to the present invention contain less than half the carbon of conventional casting powders. Furthermore, the melting behavior of the casting powders according the present invention was surprisingly found to be extremely dependent on the carbon content, in the range of small carbon contents. A large range of various demands on the melting behavior of different casting powders may be met using the same inorganic oxidic material for various types of steel and continuous casting plants by merely varying the carbon content. Thus, it is virtually unnecessary to provide the requisite extensive variety of inorganic oxidic materials of the prior art with a view to a specific metling behavior by varying the number of oxidic components of the inorganic oxidic material. With the powder of this invention, the steel producer can manage with only one inorganic oxidic material with which the melting behavior specifically needed is achievable merely by varying the active carbon content of the casting powder.

The active carbon in the casting powders according to the present invention should preferably have a grinding fineness which is characterized by a residue of less than 1% by weight on a screen having a mesh of 40 μm. The density of the active carbon powder after shaking (compacted apparent density) is preferably from 200 to 280 g/l.

From 0.5 to 10% by weight of carbon-containing material (depending on the cross-section of the mould) is sufficient in the casting powders according to the present invention.

Particularly good results are obtained if a material is used as the carbon-containing material which has itself a proportion of from 10 to 15% by weight of inorganic oxidic material, the inorganic oxidic material content being determined by the combustion residue (amount of ashes) of the carbon-containing material. The combustion residue is substantially the components of the inorganic oxidic material, that is CaO, MgO and $Fe_2O_3$ with the main proportion (more than 50%) in the carbon-containing residue material being CaO.

The inorganic oxidic material which forms more than 90% by weight of the casting powder may have conventional compositions. The inorganic oxidic material conventionally contains the following components, determined by oxidic analysis:

| | |
|---|---|
| $SiO_2$: | from 20 to 40% by weight |
| CaO: | from 20 to 45% by weight |
| $Al_2O_3$: | from 0 to 20% by weight |
| $(Na, K)_2O$: | from 0 to 20% by weight |
| (Mg, Ba)O: | from 0 to 10% by weight |
| $B_2O_3$: | from 0 to 10% by weight |
| $Fe_2O_3$: | from 0 to 10% by weight |
| MnO: | from 0 to 5% by weight |
| $P_2O_5$, $Li_2O$, $TiO_2$: | from 0 to 5% by weight |
| $F_2$: | from 2 to 10% by weight. |

The inorganic oxidic material of the casting powder is preferably melted, fritted and milled from raw mineral materials. According to the present invention, the inorganic oxidic material should preferably have a grain size distribution such that more than half of the material has a grain size of from 40 to 250 μm. A grain size distribution is preferred where from 5 to 30% by weight of the powder has a grain size of less than 40 μm, from 50 to 90% by weight of the powder is from 40 to 250 μm and from 5 to 20% by weight of the powder is more than 250 μm.

The casting powder is prepared by mixing the inorganic oxidic material and the carbon-containing material. On account of the small quantity of the carbon-containing material which is contained in the casting powder according to the present invention, there is very little dust when handling the material and applying it to the mold. Segregation during transport or relatively long period of storage is not observed under conventional conditions. However, in certain cases, it may be effective to add a small quantity of a binder or an adhesive to the casting powder when it is mixed, so that the carbon-containing material sticks to the surface of the inorganic oxidic material. However, the formation of conglutinated agglomerates should be avoided. Thus, when adhesives are used, the inorganic oxidic material is preferably first mixed with the adhesive, so that the adhesive covers the surface of the inorganic oxidic material. This material is then mixed with the carbon-containing material.

The present invention also provides a process for the continuous casting of steel, which is characterized in that a casting powder according to the present invention is introduced onto the mould as a flux. According to the present invention, the carbon-containing material content in the casting powder, as a function of the cross-section of the mould, should not exceed the value calculated by the following formula:

$$1 + \frac{0.5}{Q} = \text{\% by weight of active carbon in the casting powder,}$$

with Q designating the cross-section of the mould in $m^2$. Thus, in the case of a square mould cross-section with an edge of 240 mm (that is a mould cross-section surface of 0.058 $m^2$) the active carbon content in the casting powder should be at most 9.6% by weight.

If the dimensions of the cross-section of a rectangular mould are 1500×240 $m^2$ (that is a mould cross-section surface of 0.36 $m^2$) the active carbon content in the casting powder is at most 2.4% by weight according to the present invention.

The active carbon content should preferably be less than 80% of the above maximum value and may be up to half the given maximum value depending on the casting temperature and the particular inorganic oxidic material used, as well as the speed of casting (billet velocity).

The quantity of casting powder which is used in continuous casting is calculated in such a manner that the powder layer does not completely anneal on the mould. Metering may be carried out discontinuously and manually with visual observation of the surface of the mould.

The two figures will be discussed in detail in conjunction with the following Example which is only illustrative of the present invention and in no means is limitative thereof.

EXAMPLE

This Example shows the strong influence of the casting powders according to the present invention on the melting behavior if only small quantities of carbon-containing material are used.

An inorganic oxidic material having the following oxidic analysis is used:

| | |
|---|---|
| SiO | 38.0% by weight |
| CaO | 30.5% by weight |
| $Al_2O_3$ | 17.0% by weight |
| $Na_2O$ | 6.0% by weight |
| $K_2O$ | 0.3% by weight |
| MgO | 2.0% by weight |
| $Fe_2O_3$ | 0.4% by weight |
| $F_2$ | 5.8% by weight |
| | 100.0% by weight |

The inorganic oxidic material has a grain size distribution such that 12% by weight of the particle are less than 40μand 79% by weight of the particles are less than 250μ.

The inorganic oxidic material is mixed with various quantities of active carbon and, for comparison, with graphite and coke dust. 99% by weight of the active carbon particles have a grinding fineness of less than 40μ, a specific surface, according to BET, of 920 $m^2/g$ and a residue of combustion of 13.5% by weight.

Figure 1:
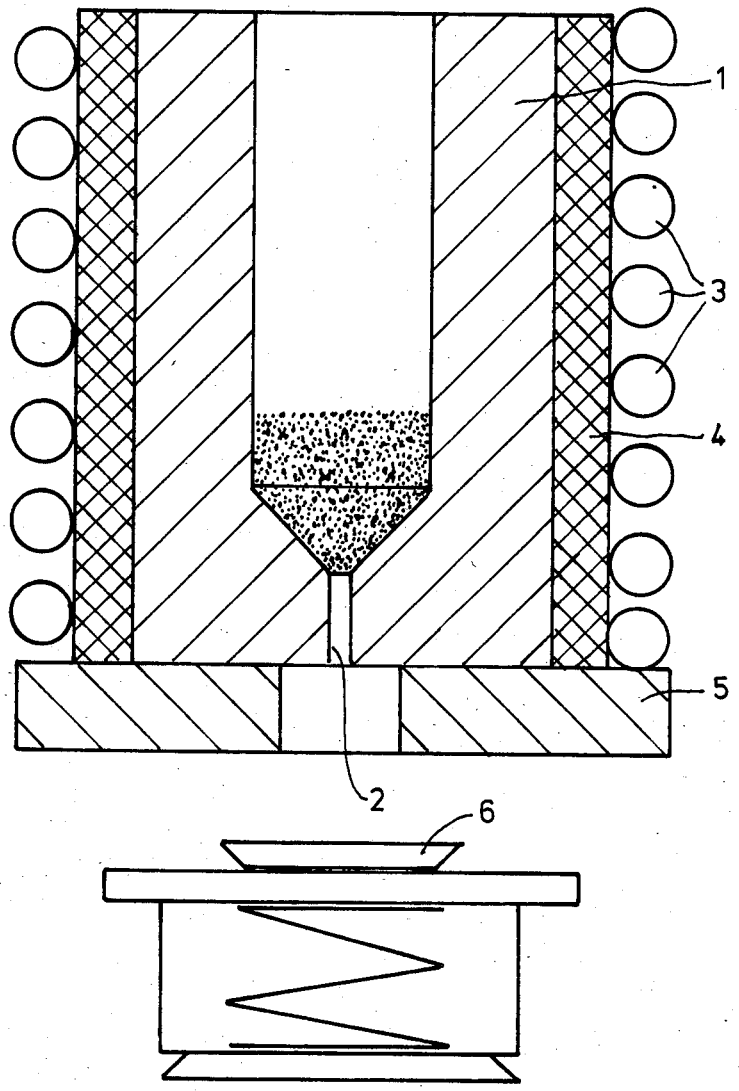
FIG. 1 illustrates a test crucible used for melting casting powder samples to obtain the data plotted in FIG. 2.

50 g of each of the various casting powder mixtures are introduced into a crucible assembly according to FIG. 1. The crucible assembly comprises a graphite crucible 1 having a cylindrical bore hole with a diameter of 38 mm, which has an outlet opening 2 with a diameter of 4.9 mm at the lower end thereof. Induction coil 3 is provided for heating the crucible. A heat insulation layer 4 of kaolin fibre web is provided between the crucible 1 and coil 3. The crucible is supported by a ring 5 of flame-resistant material. A weighing machine 6 is positioned below the outlet opening 2, on which the material issuring from the outlet opening 2 is collected.

Figure 2:
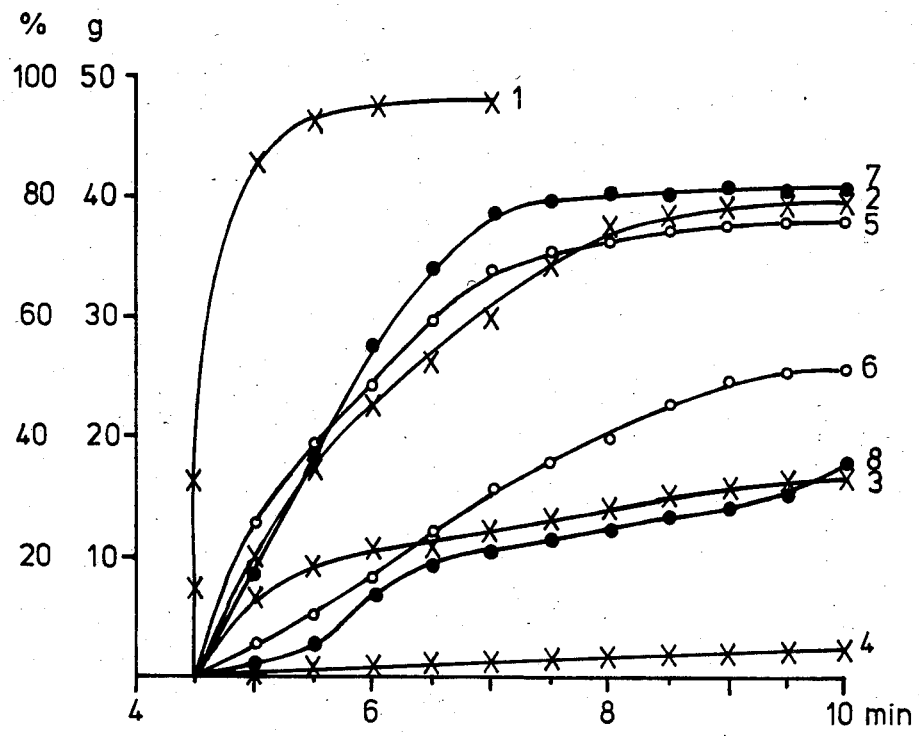
FIG. 2 illustrates the melting curves (amount vs. time) for several casting powder mixtures.

The characteristic curves of the melting process are determined by sealing the outlet opening of the crucible with a low-melting glass powder which is mixed with water to form a paste. Then to generate the curve data, 50 g of the casting powder to be tested is poured in. The crucible is then heated to 1450° C. by induction heating. The weight shown by the weighing machine is registered every 30 seconds for 10 minutes. The various curves shown in FIG. 2 are determined for various casting powders.

Curve 1: inorganic oxidic material without carbon-containing material:

Curve 2: addition of 0.5% by weight of active carbon,

Curve 3: addition of 1.0% by weight of active carbon,

Curve 4: addition of 1.5% by weight of active carbon.

For comparison:

Curve 5: addition of 10% by weight of graphite

Curve 6: addition of 20% by weight of graphite

Curve 7: addition of 5% by weight of coke dust

Curve 8: addition of 10% by weight of coke dust.

What is claimed is:

1. In a casting powder useful in continuous casting of steel, consisting essentially of an inorganic oxidic material which is meltable at the casting temperature and a carbonaceous material, the improvement which comprises said carbonaceous material being active carbon having a specific surface area, according to BET, of from 800 to 1200 square meters per gram.

2. A casting powder according to claim 1 wherein the carbonaceous material has a grinding fineness which leaves a residue of less than 1% by weight on a screen having a mesh of 40μand results in a compacted apparent density of from 200 to 280 grams per liter.

3. A casting powder according to claim 1 wherein the carbonaceous material has a combustion residue of from 10 to 15% by weight of inorganic oxidic material.

4. A casting powder according to claim 1 wherein the carbonaceous material content is from 0.5 to 10% by weight.

5. A casting powder according to claim 1 wherein the inorganic oxidic material containes the following components, determined by oxidic analysis:

| | |
|---|---|
| $SiO_2$ | from 20 to 40% by weight |
| CaO | from 20 to 45% by weight |
| $Al_2O_3$ | from 0 to 20% by weight |
| $(Na, K)_2O$ | from 0 to 20% by weight |
| (Mg, Ba)O | from 0 to 10% by weight |
| $B_2O_3$ | from 0 to 10% by weight |
| $Fe_2O_3$ | from 0 to 10% by weight |
| MnO | from 0 to 5% by weight |
| $P_2O_5$, $Li_2O$, $TiO_2$ | from 0 to 5% by weight |
| $F_2$ | from 2 to 10% by weight. |

6. A casting powder according to claim 1 to 5 wherein the inorganic oxidic material has a grain distribution of: p1 from 5 to 30% by weight $\leqq 40\mu$, $40\mu <$ from 50 to 90% by weight $\leqq 250\mu$, and $250\mu <$ from 5 to 20% by weight.

* * * * *